US010997859B2

(12) United States Patent
Lee et al.

(10) Patent No.: US 10,997,859 B2
(45) Date of Patent: May 4, 2021

(54) PARKING LOT INFORMATION SERVICE SYSTEM AND METHOD

(71) Applicants: HYUNDAI MOTOR COMPANY, Seoul (KR); KIA MOTORS CORPORATION, Seoul (KR)

(72) Inventors: Hoo Young Lee, Seoul (KR); Se Min Oh, Incheon (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 0 days.

(21) Appl. No.: 16/659,191

(22) Filed: Oct. 21, 2019

(65) Prior Publication Data

US 2020/0193824 A1 Jun. 18, 2020

(30) Foreign Application Priority Data

Dec. 12, 2018 (KR) ..... 10-2018-0159719

(51) Int. Cl.
*G08G 1/14* (2006.01)

(52) U.S. Cl.
CPC ..... *G08G 1/143* (2013.01); *G08G 1/146* (2013.01)

(58) Field of Classification Search
CPC ..... G08G 1/141; G08G 1/142; G08G 1/143; G08G 1/146
USPC ..... 340/932
See application file for complete search history.

(56) References Cited

U.S. PATENT DOCUMENTS

| | | | | |
|---|---|---|---|---|
| 2016/0042643 | A1* | 2/2016 | Hohenacker | G08G 1/146 705/13 |
| 2017/0292854 | A1* | 10/2017 | Zhang | G08G 1/146 |
| 2018/0268617 | A1* | 9/2018 | Bruce | G08G 1/142 |
| 2018/0336784 | A1* | 11/2018 | Liu | G08G 1/096866 |
| 2019/0088129 | A1* | 3/2019 | O'Callaghan | G08G 1/127 |
| 2020/0143683 | A1* | 5/2020 | Maruiwa | G08G 1/143 |

* cited by examiner

*Primary Examiner* — Omar Casillashernandez
(74) *Attorney, Agent, or Firm* — Lempia Summerfield Katz LLC

(57) ABSTRACT

A parking lot information service system and method provide position information of an available parking space in a parking lot. The system includes an electronic device that outputs parking lot information in a vehicle that is waiting to park in a parking lot associated with a multi-use facility. The system further includes a facility server that manages facility usage information of a user corresponding to a parked vehicle in the parking lot. The system also includes a parking lot server that predicts departure time of the parked vehicle by analyzing the facility usage information and generates the parking lot information based on the predicted departure time.

18 Claims, 8 Drawing Sheets

| TRANSACTION DATE AND TIME | SUMMARY | CONTENTS | AMOUNT FOR WITHDRAWAL | AMOUNT FOR DEPOSIT | ITEM |
|---|---|---|---|---|---|
| 2018.04.13 13:49 | CHECK WOORI BANK | ALAND Co., Ltd. | 32,700 | 0 | SHOPPING |
| 2018.04.13 14:14 | CHECK WOORI BANK | BAREUDA KIMSEONSAENG | 4,800 | 0 | EATING |
| 2018.04.13 17:14 | CHECK WOORI BANK | HOLLYS COFFEE HYUNDAI | 7,300 | 0 | CAFE |
| 2018.04.13 17:57 | CHECK WOORI BANK | KYOBO HOTTRACKS Co., Ltd. | 8,400 | 0 | BOOKSTORE |

FIG. 5

PARKING LOT INFORMATION SERVICE SYSTEM AND METHOD

CROSS-REFERENCE TO RELATED APPLICATION

This application claims the benefit of priority to Korean Patent Application No. 10-2018-0159719, filed in the Korean Intellectual Property Office on Dec. 12, 2018, the entire contents of which are incorporated herein by reference.

TECHNICAL FIELD

The present disclosure relates to a parking lot information service system and method for providing position information of an available parking space in a parking lot.

BACKGROUND

A parking lot associated with a multi-use facility in a densely populated area is often crowded with a number of vehicles exceeding its capacity. Thus, it may take excess time to park vehicles in the parking lot. To solve this problem, services for informing of the number of vehicles that can be parked in the parking lot and the degree of congestion are provided.

However, in the case where there is a vehicle parked in a parking space (i.e., a parking place) desired by another driver, or in the case where the parking lot is full, the driver has to spend time waiting for the corresponding parked vehicle to pull out because the driver has no way of knowing when the parked vehicle has pulled out.

SUMMARY

The present disclosure is made to solve the above-mentioned problems occurring in the prior art while advantages achieved by the prior art are maintained intact.

An aspect of the present disclosure provides a parking lot information service system and a method for predicting departure time of a parked vehicle in a parking lot associated with a multi-use facility. The system and method analyze facility usage information of a user corresponding to the parked vehicle. The system and method also provide position information with a high possibility of parking to a driver waiting to park in view of the predicted departure time.

The technical problems to be solved by the present disclosure are not limited to the aforementioned problems. Any other technical problems not mentioned herein should be clearly understood from the following description by those having ordinary skill in the art to which the present disclosure pertains.

According to an aspect of the present disclosure, a parking lot information service system includes an electronic device that outputs parking lot information in a vehicle that is waiting to park in a parking lot associated with a multi-use facility. The system further includes a facility server that manages facility usage information of a user corresponding to a parked vehicle in the parking lot. The system also includes a parking lot server that predicts departure time of the parked vehicle by analyzing the facility usage information and generates the parking lot information based on the predicted departure time.

The parking lot server may include a communication device that performs communication with the electronic device and the facility server. The parking lot server may further include a collector that collects payment information, free parking registration information, and facility usage reservation information that are included in the facility usage information. The parking lot server may also include a processor that calculates expected departure time of the parked vehicle by analyzing the plurality of pieces of information collected by the collector. The processor may further search for an available parking space based on the calculated expected departure time. The processor may also transmit position information of the corresponding available parking space to the electronic device.

The processor may calculate time of stay by analyzing reservation time and details included in the facility usage reservation information. The processor may further estimate the expected departure time based on the calculated time of stay.

The processor may calculate the remaining free parking time of the parked vehicle by analyzing the payment information and the free parking registration information. The processor may further estimate the expected departure time based on the calculated remaining free parking time.

The processor may estimate the expected departure time by assigning a weighting value according to the number of payments.

The processor may calculate time of stay by analyzing a consumption pattern by using facility usage history information. The processor may further estimate the expected departure time based on the calculated time of stay.

The processor may calculate the time of stay by using at least one of information regarding the first payment time and the final payment time, information regarding a consumption sequence, or information regarding a reservation history.

The processor may estimate an expected departure sequence of the parked vehicle based on the calculated expected departure time.

The electronic device may display a position of a parking space with a possibility of departure within a reference range based on the parking lot information.

The electronic device may display expected departure time of a parked vehicle in the parking space.

According to another aspect of the present disclosure, a parking lot information service method includes collecting facility usage information of a user from a facility server by a parking lot server, wherein the user corresponds to a parked vehicle in a parking lot associated with a multi-use facility. The method further includes predicting departure time of the parked vehicle by analyzing the facility usage information by the parking lot server. The method also includes generating parking lot information based on the predicted departure time and transmitting the generated parking lot information to an electronic device by the parking lot server.

The collecting of the facility usage information may include collecting, by the parking lot server, payment information, free parking registration information, and facility usage reservation information that are included in the facility usage information.

The predicting of the departure time of the parked vehicle may include calculating, by the parking lot server, time of stay by analyzing reservation time and details. The predicting of the departure time may further include estimating expected departure time based on the calculated time of stay by the parking lot server.

The predicting of the departure time of the parked vehicle may include calculating, by the parking lot server, the remaining free parking time of the parked vehicle by analyzing the payment information and the free parking registration information. The predicting of the departure time may further include estimating expected departure time based on the calculated remaining free parking time by the parking lot server.

The parking lot server may estimate the expected departure time by assigning a weighting value according to the number of payments.

The predicting of the departure time of the parked vehicle may include calculating time of stay by analyzing a consumption pattern by using facility usage history information by the parking lot server. The predicting of the departure time may further include estimating expected departure time based on the calculated time of stay by the parking lot server.

The parking lot server may calculate the time of stay based on information regarding the first payment time and the final payment time.

The parking lot server may identify a consumption sequence by using payment details and may calculate the time of stay by estimating an expected moving route and required time according to the consumption sequence.

The parking lot server may calculate the time of stay based on a facility usage reservation history.

The parking lot information service method may further include displaying a position of a parking space with a possibility of departure within a reference range based on the parking lot information by the electronic device after the transmitting of the generated parking lot information to the electronic device.

BRIEF DESCRIPTION OF THE DRAWINGS

The above and other objects, features and advantages of the present disclosure will be more apparent from the following detailed description taken in conjunction with the accompanying drawings:

FIGS. 4 and 5 are views illustrating methods for analyzing facility usage information according embodiments of the present disclosure;

DETAILED DESCRIPTION

Figure 1:
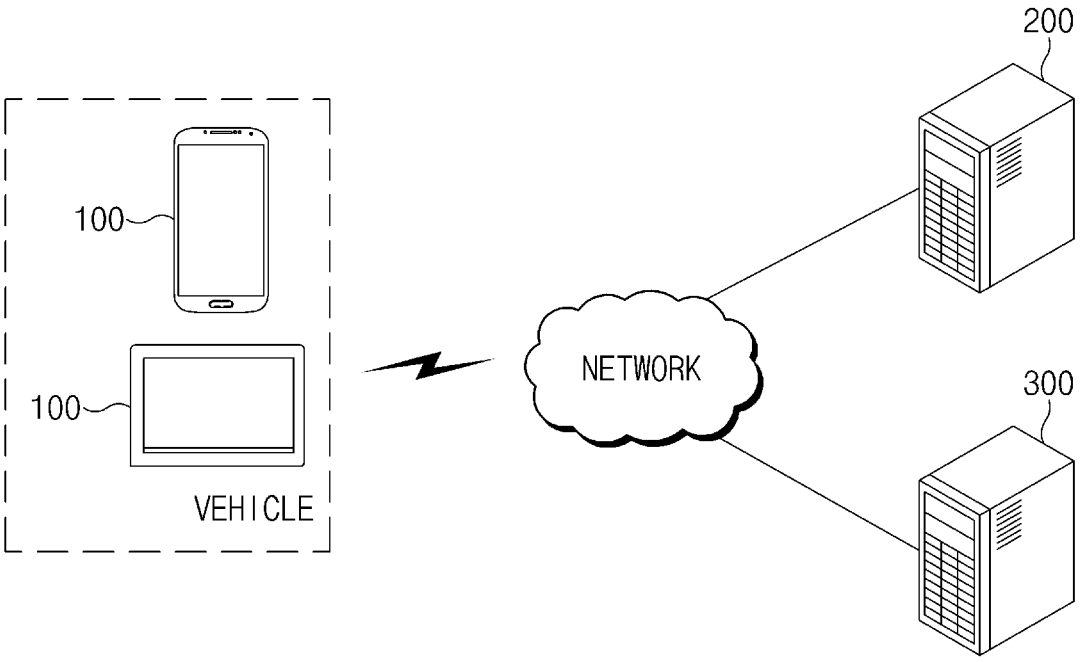
FIG. 1 is a view illustrating a configuration of a parking lot information service system according to an embodiment of the present disclosure.

Hereinafter, various embodiments of the present disclosure are described in detail with reference to the drawings. In adding the reference numerals to the components of each drawing, it should be noted that the identical or equivalent component is designated by the identical numeral even when they are displayed on other drawings. Further, in describing the embodiment of the present disclosure, a detailed description of well-known features or functions have been ruled out in order not to unnecessarily obscure the gist of the present disclosure.

In describing the components of the embodiment according to the present disclosure, terms such as first, second, "A", "B", (a), (b), and the like may be used. These terms are merely intended to distinguish one component from another component. The terms do not limit the nature, sequence or order of the constituent components. Unless otherwise defined, all terms used herein, including technical or scientific terms, have the same meanings as those generally understood by those having ordinary skill in the art to which the present disclosure pertains. Such terms as those defined in a generally used dictionary are to be interpreted as having meanings equal to the contextual meanings in the relevant field of art. Such terms are not to be interpreted as having ideal or excessively formal meanings unless clearly defined as having such in the present application.

FIG. 1 is a view illustrating a configuration of a parking lot information service system according to an embodiment of the present disclosure.

As illustrated in FIG. 1, the parking lot information service system includes an electronic device 100, a facility server 200, and a parking lot server 300 that are connected together via a network. In this embodiment, the network may be implemented by a wireless internet technology such as wireless LAN (WLAN) (e.g., Wi-Fi), wireless broadband (Wibro), and/or world interoperability for microwave access (Wimax), a short range communication technology such as Bluetooth, near field communication (NFC), and/or radio frequency identification (RFID), a mobile communication technology such as code division multiple access (CDMA), global system for mobile communication (GSM), long term evolution (LTE), and/or LTE-advanced, and/or a vehicle to everything (V2X) communication technology such as vehicle to infra (V2I).

The electronic device 100 is disposed in a vehicle that enters a parking lot associated with a multi-use facility and attempts to park (i.e., a vehicle that is waiting to park). The electronic device 100 is capable of wireless and/or wired communication. The electronic device 100 receives parking lot information from the parking lot server 300 and outputs the parking lot information in the form of visual information and/or auditory information to enable a user (i.e., a driver or a passenger) in the vehicle to identify the parking lot information.

The electronic device 100 selects one parking space in the parking lot in response to an input of the user in the vehicle that is waiting to park (i.e., the driver who is waiting to park). The driver who is waiting to park identifies the output parking lot information and selects one parking space from the available parking spaces. The electronic device 100 requests preoccupancy of the selected parking space from the parking lot server 300. Thereafter, the electronic device 100 receives an outcome of processing the preoccupancy of the selected parking space from the parking lot server 300 and outputs the outcome on a display screen.

The electronic device 100 may be implemented with a smartphone, a tablet PC, a personal digital assistant (PDA), a portable multimedia player (PMP), a notebook computer, an infotainment system, a navigation terminal, and/or an audio video navigation (AVN).

The facility server 200 collects and manages facility usage information of users who use the multi-use facility. The facility server 200 obtains the facility usage information from a plurality of payment terminals and unmanned ticketing machines installed in the multi-use facility. The facility usage information includes payment information, free parking registration information, and facility usage reservation information. Although not illustrated, the facility server 200 includes a communication device, a memory, and a processor.

The parking lot server 300 manages vehicles entering and leaving the parking lot associated with the multi-use facility and vehicles parked in parking spaces (i.e., parking places). The parking lot server 300 brings information regarding the visit history of each vehicle to the parking lot into a database (DB) and manages the database. The visit history information includes the visit date, the arrival time, the departure time, the vehicle number, the parking time (the time of stay), and/or the facility usage information.

The parking lot server 300 calculates expected departure time of parked vehicles by analyzing the payment information, the free parking registration information, and the facility usage reservation information that are included in the facility usage information. The parking lot server 300 estimates (determines) an expected departure sequence of the parked vehicles based on the calculated expected departure time. The parking lot server 300 transmits, to the electronic device 100, expected departure information that includes the expected departure time and the expected departure sequence of the parked vehicles.

The parking lot server 300 may search for parking spaces pertaining to a predetermined range (the top 30 percent) in descending order of the possibility of departure based on the expected departure time and the expected departure sequence of the parked vehicles. The parking lot server 300 may provide information regarding the positions of the found parking spaces to the electronic device 100.

The parking lot server 300 processes preoccupancy of a parking space selected by the driver who is waiting to park, in response to a request of the driver. When there is a vehicle parked in the selected parking space, the parking lot server 300 places the vehicle of the driver who is waiting to park, on a waiting list for parking in the corresponding parking space and assigns a waiting number. When the vehicle parked in the selected parking space is pulled out, the parking lot server 300 informs the driver that the corresponding parking space is available, according to the waiting number thereof.

Figure 2:
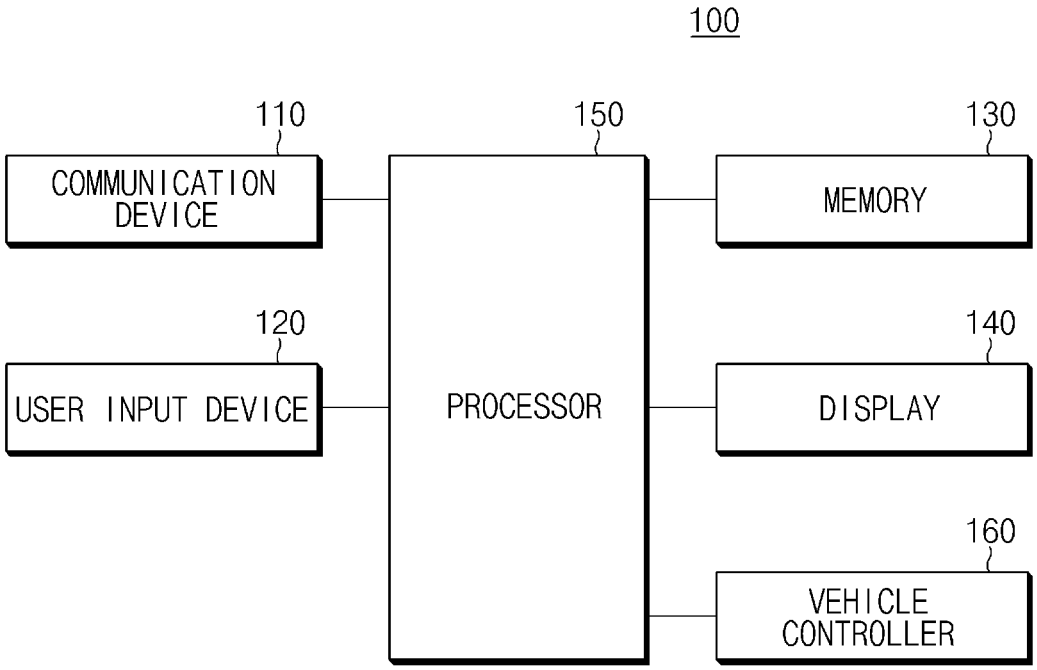
FIG. 2 is a block diagram illustrating an electronic device illustrated in FIG. 1.

FIG. 2 is a block diagram illustrating the electronic device 100 illustrated in FIG. 1.

As illustrated in FIG. 2, the electronic device 100 includes a communication device 110, a user input device 120, a memory 130, a display 140, a processor 150, and a vehicle controller 160.

The communication device 110 performs wireless communication. The wireless communication may be implemented by at least one of communication technologies such as wireless internet (e.g., Wi-Fi), short range communication (e.g., Bluetooth and NFC), mobile communication, and vehicle communication (e.g., V2X).

The communication device 110 may support in-vehicle network (IVN). A controller area network (CAN), a media oriented systems transport (MOST) network, a local interconnect network (LIN), and/or an x-by-wire (Flexray) may be used as the in-vehicle network.

The user input device 120 generates data according to a user operation. The user input device 120 may be implemented with a keyboard, a keypad, a button, a switch, a touch pad, and/or a touch screen.

The memory 130 may store programs for controlling operations of the processor 150 and input/output data. The memory 130 may store the parking lot information received via the communication device 110. The memory 130 may store map data and parking map data. The parking map data may be received from the parking lot server 300.

The memory 130 may be implemented with at least one storage medium (recording medium) among storage media such as a flash memory, a hard disk, a secure digital (SD) card, an random access memory (RAM), a static random access memory (SRAM), a read only memory (ROM), a programmable read only memory (PROM), an electrically erasable and programmable ROM (EEPROM), an erasable and programmable ROM (EPROM), and a register.

The display 140 outputs processing states and processing outcomes according to operations of the processor 150 as visual information. The display 140 displays available parking spaces (i.e., available parking places), based on the parking lot information provided by the parking lot server 300. The display 140 displays, on the parking map, a parking status, expected departure time and an expected departure sequence for each parked vehicle, the number of vehicles waiting to park, and/or waiting time.

The display 140 may include one or more of a liquid crystal display (LCD), a thin film transistor-liquid crystal display (TFT LCD), an organic light-emitting diode (OLED) display, a flexible display, a three-dimensional (3D) display, a transparent display, a head-up display (HUD), a touch screen, and a cluster.

The display 140 may include an audio output module, such as a speaker, which is capable of outputting audio data. For example, the display 140 may display the positions of the available parking spaces and may output a sound signal (i.e., an audio signal) through the speaker.

The display 140 may be implemented with a touch screen combined with a touch sensor and may be used as an input device as well as an output device. A touch film or a touch pad may be used as the touch sensor.

The processor 150 controls an overall operation of the electronic device 100. The processor 150 may include at least one of an application specific integrated circuit (ASIC), a digital signal processor (DSP), programmable logic devices (PLDs), field programmable gate arrays (FPGAs), a central processing unit (CPU), microcontrollers, and microprocessors.

The processor 150 receives the parking lot information from the parking lot server 300 via the communication device 110. The processor 150 outputs expected departure information of parked vehicles on the display 140 based on the received parking lot information. The expected departure information includes expected departure time and an expected departure sequence.

The processor 150 displays expected departure information of parked vehicles pertaining to an upper predetermined range with a high probability (possibility) of departure. The processor 150 displays different colors according to possibilities of departure to improve the visibility of the driver who is waiting to park.

The vehicle controller 160 supports autonomous driving and parking of the vehicle. The vehicle controller 160 parks the vehicle in a parking space set as a destination according to an instruction of the processor 150. The vehicle controller 160 may be implemented by applying various well-known autonomous driving systems and autonomous parking systems. Therefore, a specific description thereabout has been omitted.

Figure 3:
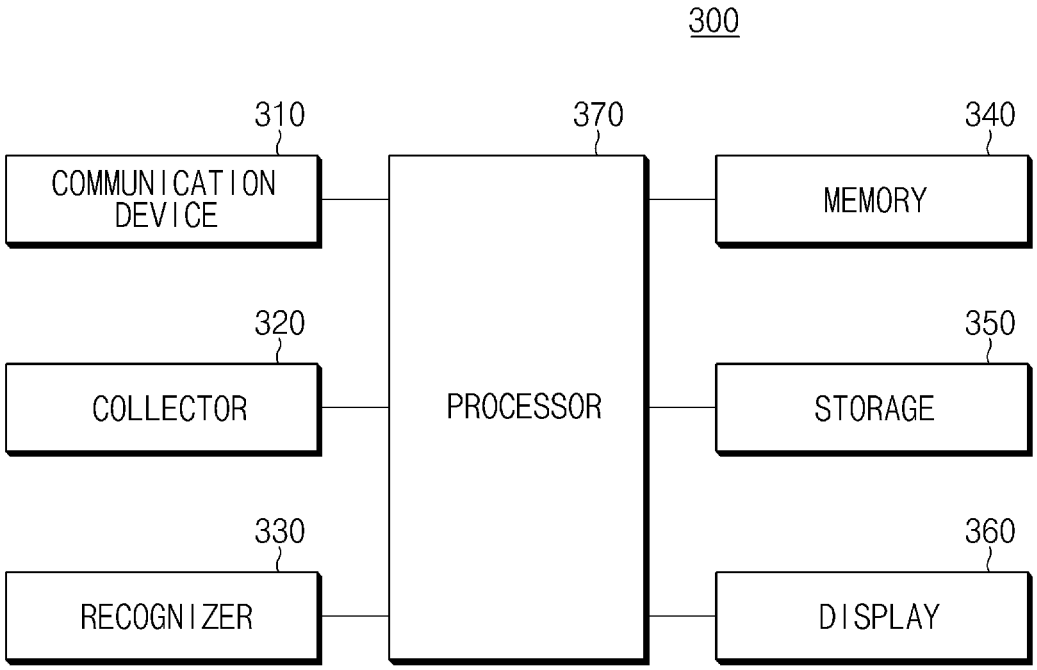
FIG. 3 is a block diagram illustrating a parking lot server illustrated in FIG. 1.
Figure 4:
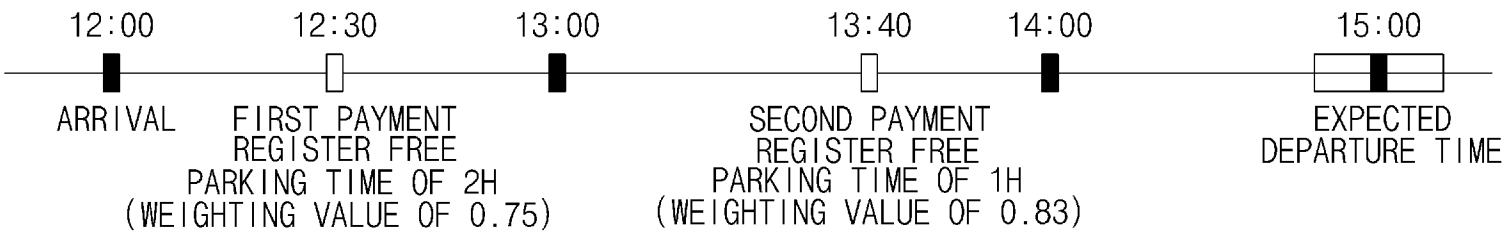

FIG. 3 is a block diagram illustrating the parking lot server 300 illustrated in FIG. 3. FIGS. 4 and 5 are views illustrating methods for analyzing facility usage information according embodiments of the present disclosure.

Referring to FIG. 3, the parking lot server 300 includes a communication device 310, a collector 320, a recognizer 330, a memory 340, storage 350, a display 360, and a processor 370.

The communication device 310 performs data communication with the electronic device 100 and the facility server 200. The communication device 310 performs communication using at least one of communication technologies such as wired/wireless internet, short range communication, mobile communication, and V2X.

The collector 320 accesses the facility server 200 via the communication device 310 and collects payment information, free parking registration information, and facility usage reservation information that are included in the facility usage information.

The recognizer 330 recognizes vehicles entering and leaving the parking lot through a plurality of cameras (not illustrated) that are installed in the parking lot. The recognizer 330 obtains an image of a vehicle entering the parking lot through a camera installed at the entrance of the parking lot and extracts the vehicle number from the obtained image. Furthermore, the recognizer 330 obtains an image of a vehicle leaving the parking lot and/or a parking space through a camera installed at the exit of the parking lot and/or in the parking space and recognizes the vehicle number in the obtained image. The cameras may be implemented with at least one image sensor among images sensors such as a charge coupled device (CCD) image sensor, a complementary metal oxide semiconductor (CMOS) image sensor, a charge priming device (CPD) image sensor, and a charge injection device (CID) image sensor. The cameras may include an image processor that performs image processing, such as noise removal, color reproduction, file compression, image quality adjustment, and color saturation adjustment, on images obtained through the at least one image sensor.

The memory 340 may store software programmed to cause the processor 370 to perform predetermined operations and may store input/output data. The memory 340 may store an image processing algorithm and a deep learning algorithm.

The memory 340 may be implemented with at least one storage medium (recording medium) among storage media such as a flash memory, a hard disk, an SD card, a RAM, an SRAM, a ROM, a PROM, an EEPROM, an EPROM, and a register.

The storage 350 cumulatively stores information regarding the visit of each vehicle to the parking lot and facility usage information collected through the collector 320. In other words, the storage 350 stores information such as a visit history and a facility usage history (i.e., a payment history and a facility usage reservation history) in a database (DB).

The storage 350 may be implemented with at least one storage medium (recording medium) among storage media such as a flash memory, a hard disk, an SD card, a register, a removable disk, and web storage.

The display 360 outputs processing states and processing outcomes according to operations of the processor 370 as visual information. The display 360 may include at least one of an LCD, a TFT LCD, an OLED display, a flexible display, a three-dimensional display, a transparent display, an HUD, and a touch screen.

The processor 370 controls an overall operation of the parking lot server 300. The processor 370 may include at least one of an ASIC, a DSP, a PLD, FPGAs, a CPU, a microcontroller, and a microprocessor.

The processor 370 analyzes facility usage reservation information, payment information, and free parking registration information collected through the collector 320 and estimates (predicts) expected departure time and an expected departure sequence of a parked vehicle. The processor 370 estimates the expected time of stay of the parked vehicle by using reservation time and details included in the facility usage reservation information. The processor 370 may identify the minimum time of stay through the start time and the running time of a movie or a play. Furthermore, the processor 370 may predict the time of stay in a reserved facility with reference to information regarding the average time of stay for each type of facility.

For example, in the case where a user of the parked vehicle reserved a movie with a running time of 3 hours that starts at 2 p.m., the processor 370 predicts at least 4 hours including the running time to be the expected time of stay. In an embodiment where the user of the parked vehicle reserved a pork-cutlet restaurant for the family, the processor 370 estimates an average meal time of at least 1 hour and 30 minutes to be the expected time of stay.

The processor 370 may estimate the expected time of stay of the parked vehicle by analyzing the payment information and the free parking registration information. When free parking time is registered for each payment, the processor 370 identifies the remaining free parking time through the corresponding free parking registration information to predict the expected departure time. In this case, the processor 370 assigns a weighting value according to the number of payments and determines that the probability of departure becomes higher with an increase in the number of payments. The processor 370 may calculate an optimal weighting value through a deep learning algorithm.

In the case where free-parking vehicle registration is not performed during payment, the processor 370 registers parking information by identifying vehicle information by using information regarding the owner of a payment means.

For example, in the case where first payment is made at 12:30 after the vehicle enters the parking lot at 12:00, as illustrated in FIG. 4, the processor 370 estimates the expected departure time by calculating free parking time and a weighting value with reference to the corresponding payment information and free parking registration information. Thereafter, if second payment is made at 13:40, the processor 370 consistently estimates the expected departure time by calculating free parking time and a weighting value by using the second payment information and the free parking registration information.

Furthermore, the processor 370 may analyze a consumption pattern based on facility usage history information stored in the storage 350 other than the information collected through the collector 320. In other words, the processor 370 analyzes the user's consumption pattern by analyzing previous payment information cumulatively stored in the storage 350. The processor 370 may calculate the average time of stay in the multi-use facility by analyzing information regarding the first payment time and the final payment time during the user's visit to the multi-use facility. The processor 370 may calculate the average time of stay in the multi-use facility by identifying an expected moving route and required time by analyzing the sequence and time of consumption, based on payment details included in payment information during the user's visit to the multi-use facility.

In addition, the processor 370 may calculate the average time of stay of the user in the multi-use facility in view of a preferred performance and the start time and the running time of the performance by using previous facility usage reservation information (i.e., a facility usage reservation history).

For example, in the case where the credit card payment details during the user's previous visit to the multi-use facility are as shown in FIG. 5, the processor 370 estimates the expected departure time by identifying the first payment time (13:49), the final payment time (17:57), and the departure time and analyzing each payment time and an expected moving route with reference to the sequence of consumption (shopping→eating→cafe→bookstore).

The processor 370 calculates the time of stay in the multi-use facility (i.e., the time of stay) by analyzing facility usage information and estimates the expected departure time based on the calculated time of stay. The processor 370 determines an expected departure sequence of the parked vehicle based on the expected departure time.

The processor 370 transmits expected departure information (parking lot information) including the expected departure time and the expected departure sequence to the electronic device 100 via the communication device 310.

The processor 370 receives a request for preoccupancy of a parking space from the electronic device 100 via the communication device 310 and processes the preoccupancy of the corresponding parking space. In the case where a parked vehicle occupies the parking space requested to be preempted, i.e., reserved, or at least one other electronic device requesting preoccupancy of the parking space is present, the processor 370 places the vehicle corresponding to the electronic device 100 on a waiting list for parking in the parking space and assigns a waiting number.

When the vehicle parked in the parking space pulls out of the parking space, the processor 370 transmits notification that the parking space is available to the electronic device 100 corresponding to the first vehicle in line that is waiting to park in the corresponding parking space according to the waiting number.

When the vehicle corresponding to the electronic device 100 receiving the notification parks in the parking space, the processor 370 identifies the completion of parking through the recognizer 330. The processor 370, when identifying the completion of parking, updates information about the corresponding parking space and transmits the updated information to an electronic device 100 of another vehicle that is waiting to park.

Figure 6:
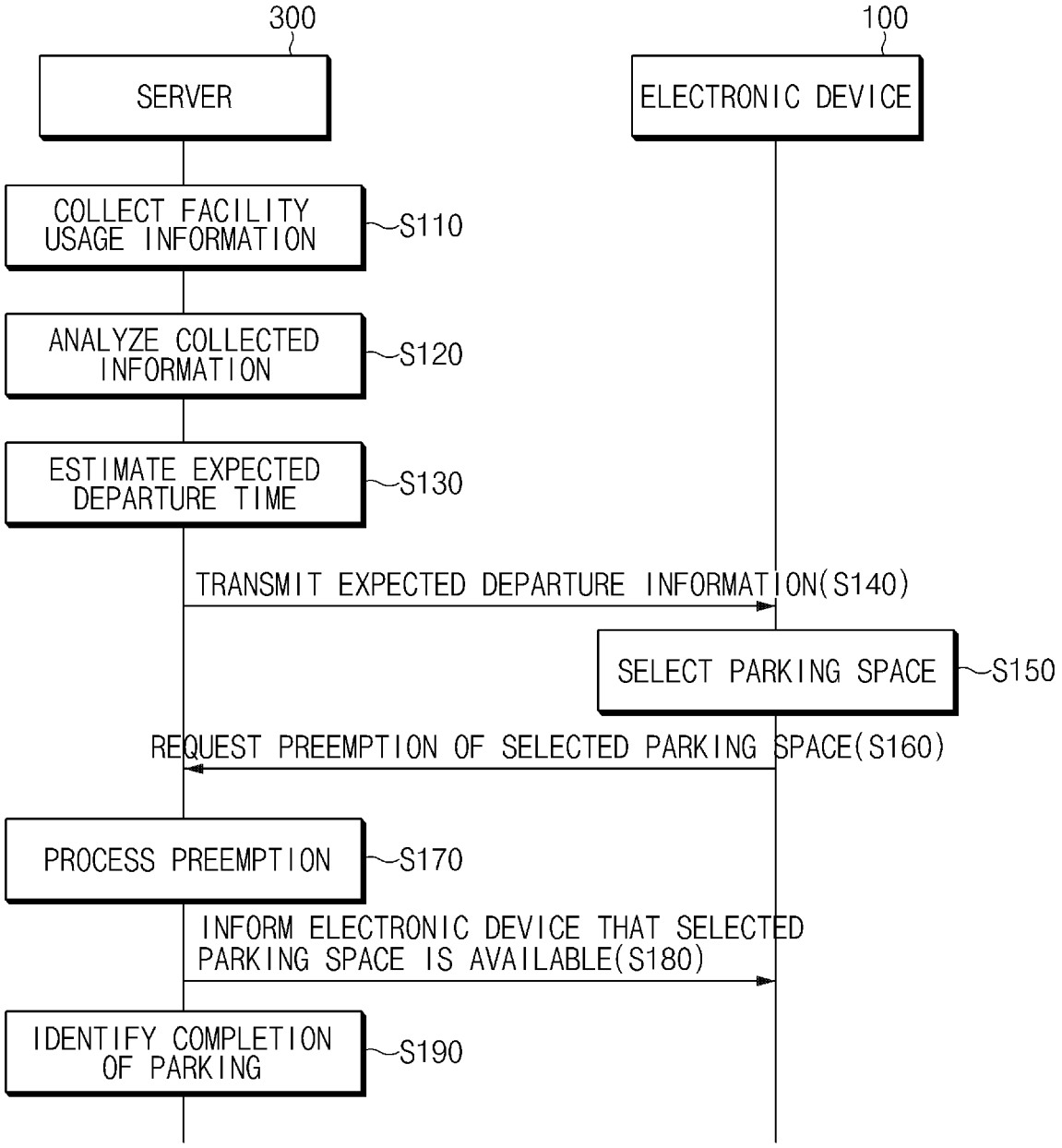
FIG. 6 is a flowchart illustrating a parking lot information service method according to an embodiment of the present disclosure.

FIG. 6 is a flowchart illustrating a parking lot information service method according to an embodiment of the present disclosure.

The parking lot server 300 collects facility usage information of users corresponding to parked vehicles in the parking lot associated with the multi-use facility (S110). The parking lot server 300 collects the facility usage information from the facility server 200.

The parking lot server 300 analyzes the time of stay of the parked vehicles based on the collected information (S120). In other words, the parking lot server 300 calculates the time of stay of the parked vehicles by analyzing the collected information.

The parking lot server 300 estimates expected departure time of the parked vehicles based on the analysis results (S130). The parking lot server 300 determines an expected departure sequence of the parked vehicles based on the expected departure time.

The parking lot server 300 transmits expected departure information including the estimated expected departure time to the electronic device 100 (S140). The expected departure information also includes the expected departure sequence information.

The electronic device 100 displays available parking spaces based on the expected departure information. The electronic device 100 further selects one parking space from the displayed available parking spaces (S150). Based on the expected departure information, the electronic device 100 displays expected departure information of parked vehicles with a possibility of departure within a preset range, among the parked vehicles in the parking lot, on the display 140. The electronic device 100 displays the expected departure time of the parked vehicles and the number of vehicles that are waiting to park. The electronic device 100 selects one parking space from the parking spaces in response to a user input entered through the user input device 120.

The electronic device 100 requests preoccupancy of the selected parking space from the parking lot server 300 (S160). The electronic device 100 transmits the position information of the selected parking space to the parking lot server 300.

The parking lot server 300 processes the preoccupancy of the selected parking space in response to the request of the electronic device 100 (S170). In the case where another vehicle waiting to park also requests preoccupancy of the parking space requested to be preempted, the parking lot server 300 assigns waiting numbers according to the priorities of the vehicles that request the preoccupancy and transmits the assigned waiting numbers to the electronic device 100. When the vehicle parked in the parking space requested to be preempted is pulled out, the parking lot server 300 updates the assigned waiting numbers and transmits the updated waiting numbers to the electronic device 100. The electronic device 100 displays, in real time, the waiting number of the vehicle in which the electronic device 100 is mounted.

When the parking space is available by processing the preoccupancy of the parking space, the parking lot server 300 transmits notification for informing of the fact, to the electronic device 100 (S180).

Thereafter, the parking lot server 300 determines whether the vehicle having the electronic device 100 mounted therein is parked in the parking space (S190). When it is determined that the corresponding vehicle is parked in the parking space, the parking lot server 300 returns to S110 to collect facility usage information.

Figure 7:
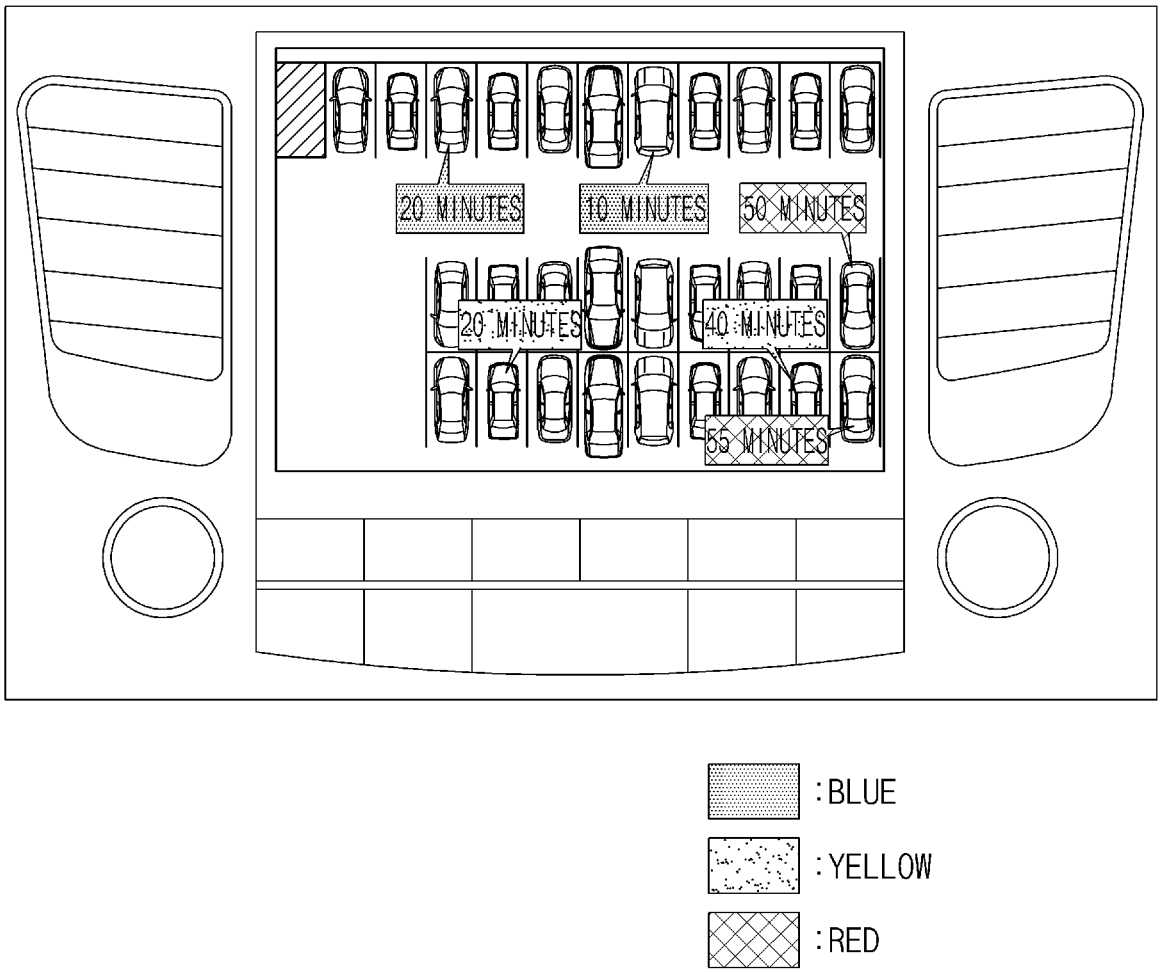
FIGS. 7 and 8 are views illustrating methods for displaying expected departure information according to embodiments of the present disclosure.
Figure 8:
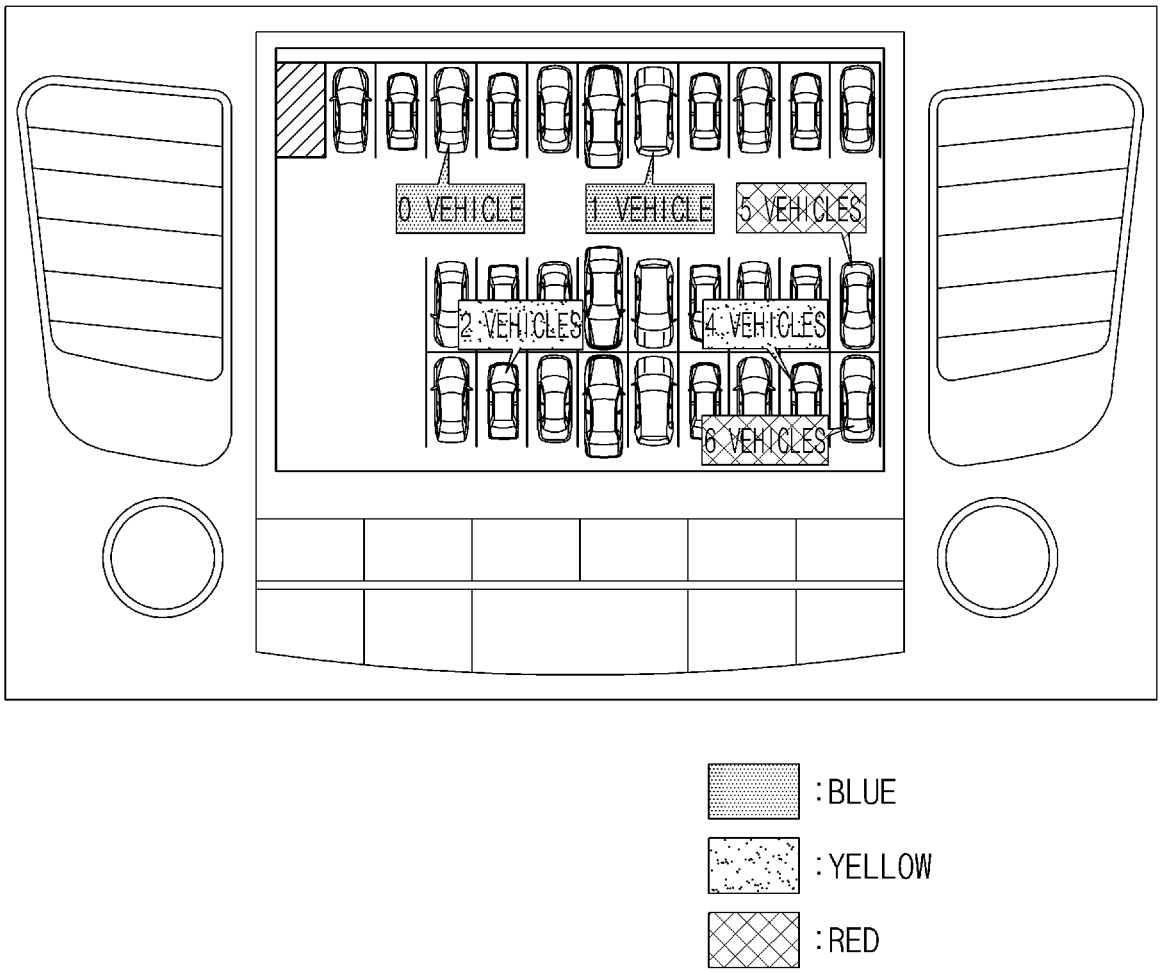

FIGS. 7 and 8 are views illustrating methods for displaying expected departure information according to embodiments of the present disclosure.

The electronic device 100 may display different colors according to probabilities (possibilities) of departure.

Referring to FIG. 7, the electronic device 100 may extract parking spaces from which parked vehicles will be pulled out within 60 minutes, from parking spaces in the parking lot and may display different colors according to probabilities that the vehicles parked in the extracted parking spaces will be pulled out. In other words, the electronic device 100 displays expected departure time of the vehicles parked in the extracted parking spaces. The electronic device 100 displays expected departure time of less than 20 minutes in blue, expected departure time of more than 20 minutes and less than 40 minutes in yellow, and expected departure time of more than 40 minutes and less than 60 minutes in red.

Referring to FIG. 8, the electronic device 100 may extract parking spaces that 10 or fewer vehicles are waiting to park in, from parking spaces in the parking lot. The electronic device 10 may also display different colors according to probabilities that vehicles parked in the extracted parking spaces will be pulled out. The electronic device 100 displays the number of vehicles waiting to park in blue when the number is smaller than or equal to 1, in yellow when the number ranges from 2 to 4, and in red when the number ranges 5 to 10. The electronic device 100 may display different colors according to probabilities of departure.

According to the embodiments of the present disclosure, the parking lot information service system and method predict the departure time of the parked vehicle in the parking lot associated with the multi-use facility by analyzing the facility usage information of the user corresponding to the parked vehicle and provide the position information with the high possibility of parking to the driver waiting to park in view of the predicted departure time. Thereby, the parking lot information service system and method enable the driver to save time spent finding an empty parking space and park in a desired parking place in the parking lot.

Hereinabove, although the present disclosure has been described with reference to various embodiments and the accompanying drawings, the present disclosure is not limited thereto, but may be variously modified and altered by those having ordinary skill in the art to which the present disclosure pertains without departing from the spirit and scope of the present disclosure claimed in the following claims. Therefore, the various embodiments of the present disclosure are provided to explain the spirit and scope of the present disclosure, but not to limit them, so that the spirit and scope of the present disclosure is not limited by the embodiments. The scope of the present disclosure should be construed on the basis of the accompanying claims. All the technical ideas within the scope equivalent to the claims should be included in the scope of the present disclosure.

What is claimed is:

1. A parking lot information service system comprising:

an electronic device configured to output parking lot information in a vehicle that is waiting to park in a parking lot associated with a multi-use facility;

a facility server configured to manage facility usage information of a user corresponding to a parked vehicle in the parking lot; and a parking lot server configured to predict departure time of the parked vehicle by analyzing the facility usage information and to generate the parking lot information based on the predicted departure time, wherein the parking lot server calculates a remaining free parking time of the parked vehicle by analyzing payment information and free parking registration information included in the facility usage information and estimates an expected departure time based on the calculated remaining free parking time.

2. The parking lot information service system of claim 1, wherein the parking lot server includes:

a communication device configured to perform communication with the electronic device and the facility server;

a collector configured to collect the payment information, the free parking registration information, and facility usage reservation information that are included in the facility usage information; and a processor configured to calculate the expected departure time of the parked vehicle by analyzing the plurality of pieces of information collected by the collector, to search for an available parking space based on the calculated expected departure time, and to transmit position information of the corresponding available parking space to the electronic device.

3. The parking lot information service system of claim 2, wherein the processor calculates time of stay by analyzing reservation time and details included in the facility usage reservation information and estimates the expected departure time based on the calculated time of stay.

4. The parking lot information service system of claim 1, wherein the processor estimates the expected departure time by assigning a weighting value according to the number of payments.

5. The parking lot information service system of claim 2, wherein the processor calculates time of stay by analyzing a consumption pattern by using facility usage history information and estimates the expected departure time based on the calculated time of stay.

6. The parking lot information service system of claim 5, wherein the processor calculates the time of stay by using at least one of information regarding the first payment time and the final payment time, information regarding a consumption sequence, or information regarding a reservation history.

7. The parking lot information service system of claim 2, wherein the processor estimates an expected departure sequence of the parked vehicle based on the calculated expected departure time.

8. The parking lot information service system of claim 1, wherein the electronic device displays a position of a parking space with a possibility of departure within a reference range based on the parking lot information.

9. The parking lot information service system of claim 8, wherein the electronic device displays expected departure time of the parked vehicle in the parking space.

10. A parking lot information service method comprising steps of:

collecting, by a parking lot server, facility usage information of a user from a facility server, wherein the user corresponds to a parked vehicle in a parking lot associated with a multi-use facility;

predicting, by the parking lot server, departure time of the parked vehicle by analyzing the facility usage information; and generating, by the parking lot server, parking lot information based on the predicted departure time, and transmitting the generated parking lot information to an electronic device, wherein the step of the predicting of the departure time of the parked vehicle includes a step of calculating, by the parking lot server, a remaining free parking time of the parked vehicle by analyzing payment information and free parking registration information included in the facility usage information and estimating an expected departure time based on the calculated remaining free parking time.

11. The parking lot information service method of claim 10, wherein the step of the collecting of the facility usage information includes a step of:

collecting, by the parking lot server, the payment information, the free parking registration information, and facility usage reservation information that are included in the facility usage information.

12. The parking lot information service method of claim 11, wherein the step of the predicting of the departure time of the parked vehicle includes a step of:

calculating, by the parking lot server, time of stay by analyzing reservation time and details, and estimating expected departure time, based on the calculated time of stay.

13. The parking lot information service method of claim 10, wherein the parking lot server estimates the expected departure time by assigning a weighting value according to the number of payments.

14. The parking lot information service method of claim 11, wherein the step of the predicting of the departure time of the parked vehicle includes a step of:

calculating, by the parking lot server, ration of stay by analyzing a consumption pattern by using facility usage history information and estimating expected departure time, based on the calculated time of stay.

15. The parking lot information service method of claim 14, wherein the parking lot server calculates the time of stay, based on information regarding the first payment time and the final payment time.

16. The parking lot information service method of claim 14, wherein the parking lot server identifies a consumption sequence by using payment details and calculates the time of stay by estimating an expected moving route and required time according to the consumption sequence.

17. The parking lot information service method of claim 14, wherein the parking lot server calculates the time of stay based on a facility usage reservation history.

18. The parking lot information service method of claim 10, further comprising, after the step of the transmitting of the generated parking lot information to the electronic device, a step of:

displaying a position of a parking space with a possibility of departure within a reference range based on the parking lot information by the electronic device.

* * * * *